US011325228B2

(12) United States Patent
Osada et al.

(10) Patent No.: US 11,325,228 B2
(45) Date of Patent: May 10, 2022

(54) ROTARY IMPACT TOOL

(71) Applicant: MAKITA CORPORATION, Anjo (JP)

(72) Inventors: Takaaki Osada, Anjo (JP); Hirokatsu Yamamoto, Anjo (JP); Goshi Ishikawa, Anjo (JP); Kunihisa Shima, Anjo (JP)

(73) Assignee: MAKITA CORPORATION, Anjo (JP)

( * ) Notice: Subject to any disclaimer, the term of this patent is extended or adjusted under 35 U.S.C. 154(b) by 652 days.

(21) Appl. No.: 15/948,003

(22) Filed: Apr. 9, 2018

(65) Prior Publication Data

US 2018/0297179 A1 Oct. 18, 2018

(30) Foreign Application Priority Data

Apr. 17, 2017 (JP) ..... JP2017-081412

(51) Int. Cl.

| | |
|---|---|
| ***B25B 21/00*** | (2006.01) |
| ***B25F 5/00*** | (2006.01) |
| ***B25B 21/02*** | (2006.01) |
| ***B25B 23/147*** | (2006.01) |

(52) U.S. Cl.

CPC ..... *B25B 21/008* (2013.01); *B25B 21/02* (2013.01); *B25B 21/023* (2013.01); *B25B 21/026* (2013.01); *B25B 23/1475* (2013.01); *B25F 5/001* (2013.01)

(58) Field of Classification Search

CPC ..... B25B 21/008; B25B 21/02; B25B 21/023; B25B 23/1475; B25B 5/001; B25B 21/026; B25B 21/00; B25B 23/145; B25F 5/001

See application file for complete search history.

(56) References Cited

U.S. PATENT DOCUMENTS

| | | | | |
|---|---|---|---|---|
| 6,680,595 | B2 * | 1/2004 | Ito | B25B 23/1405 173/11 |
| 7,036,605 | B2 * | 5/2006 | Suzuki | B25B 21/02 173/176 |
| 8,678,106 | B2 * | 3/2014 | Matsunaga | B25B 21/008 173/176 |
| 9,643,300 | B2 * | 5/2017 | Kumagai | B25B 21/026 |

(Continued)

FOREIGN PATENT DOCUMENTS

| | | | |
|---|---|---|---|
| JP | S63-74576 | A | 4/1988 |
| JP | H07-314344 | A | 12/1995 |

(Continued)

OTHER PUBLICATIONS

Oct. 6, 2020 Office Action issued in Japanese Patent Application No. 2017-081412.

(Continued)

*Primary Examiner* — Chelsea E Stinson
*Assistant Examiner* — Scott A Howell
(74) *Attorney, Agent, or Firm* — Oliff PLC

(57) ABSTRACT

A rotary impact tool in one aspect of the present disclosure includes a motor, an impact mechanism, an impact detector, and a controller. The controller executes constant duty ratio control from when the motor is started until an impact is detected by the impact detector. The controller executes constant rotation speed control in response to detection of an impact by the impact detector.

5 Claims, 9 Drawing Sheets

(56) References Cited

U.S. PATENT DOCUMENTS

| | | | | |
|---|---|---|---|---|
| 9,878,435 | B2 * | 1/2018 | Ito | B25B 21/00 |
| 10,040,178 | B2 * | 8/2018 | Kondo | B25F 5/006 |
| 10,343,268 | B2 * | 7/2019 | Hirabayashi | B25B 21/02 |
| 10,427,282 | B2 * | 10/2019 | Ishikawa | B25B 23/1475 |
| 2003/0155878 | A1 * | 8/2003 | Murai | B60L 3/12 318/268 |
| 2004/0144552 | A1 * | 7/2004 | Suzuki | B25B 21/02 173/2 |
| 2011/0315417 | A1 * | 12/2011 | Matsunaga | B25B 23/14 173/176 |
| 2014/0165525 | A1 * | 6/2014 | Nagata | A01D 34/78 56/11.2 |
| 2015/0231770 | A1 * | 8/2015 | Kusakawa | B25B 23/1475 173/93.5 |
| 2015/0349695 | A1 * | 12/2015 | Hosokawa | B23B 45/02 173/2 |
| 2016/0008961 | A1 | 1/2016 | Takano et al. | |
| 2016/0107297 | A1 * | 4/2016 | Ishikawa | B25B 21/008 173/179 |

FOREIGN PATENT DOCUMENTS

| | | | |
|---|---|---|---|
| JP | 2010-207951 | A | 9/2010 |
| WO | 2014/162862 | A1 | 10/2014 |

OTHER PUBLICATIONS

Feb. 9, 2021 Office Action issued in Japanese Patent Application No. 2017-081412.

* cited by examiner

ROTARY IMPACT TOOL

CROSS-REFERENCE TO RELATED APPLICATIONS

This application claims the benefit of Japanese Patent Application No. 2017-081412 filed on Apr. 17, 2017 with the Japan Patent Office, the entire disclosure of which is incorporated herein by reference.

BACKGROUND

The present disclosure relates to a rotary impact tool configured to rotate by a rotational force of a motor, and to apply an impact force in a rotational direction when a torque equal to or greater than a specified value is applied from outside.

A rotary impact tool includes a hammer that rotates by receiving a rotational force of a motor, and an anvil that rotates by receiving a rotational force of the hammer. When a torque equal to or greater than a specified value is applied from outside to the anvil to which a tool bit is attached, the hammer moves away from the anvil to rotate idle. After the hammer rotates idle by a specified angle, the hammer moves toward the anvil so as to apply an impact to the anvil in a rotational direction, and simultaneously in a forward axial direction to keep a tool bit seated (such as a phillips bit seated in a phillips head screw).

According to the rotary impact tool, upon fixing a screw to a workpiece, it is possible to firmly tighten the screw to the workpiece by the impact of the hammer to the anvil. A rotary impact tool disclosed in Japanese Unexamined Patent Application Publication No. 63-074576 executes constant rotation speed control in which a rotational speed of a motor is controlled to a constant rotational speed, in order to keep a tightening torque of a screw constant.

SUMMARY

Constant rotation speed control of the motor as above can keep the rotational speed of the motor upon application of an impact substantially constant, and can control the tightening torque of the screw by the impact to a desired torque. However, if the motor, after started, is configured to be driven at a constant rotational speed, then the rotational speed of the motor is limited even during no-load operation or low-load operation of the motor before application of the impact.

Therefore, in the related art as mentioned above, time required to tighten a screw to a workpiece increases. It is possible that workability of the rotary impact tool is deteriorated.

In order to reduce the possibility as above, a target rotational speed of the motor in the constant rotation speed control may be switched, after the start of the motor. The motor may be rotated at higher speed than when an impact is applied, until the impact is applied.

However, under the high speed rotation of the motor as above, when a hammer, after applying an impact to an anvil, moves away from the anvil in order to be ready for the next impact, the hammer sometimes rotates faster than the axial movement of the hammer to a position where the hammer can apply an impact to the anvil.

In this case, the hammer jumps over the anvil and rotates without applying an impact to the anvil, thereby causing impact failure. In addition, upon impact failure as such, the number of impact per rotation of the motor decreases, so that torque accuracy may deteriorate. Or, since a cam of the hammer jumps over the anvil while rubbing the anvil, these components may deteriorate.

It is desirable that one aspect of the present disclosure can provide a technique in which, while a tightening torque can be controlled to a desired torque by constant rotation speed control of a motor, the motor is ensured to be rotated at high speed before an impact is applied, without causing impact failure.

A rotary impact tool in one aspect of the present disclosure includes a motor, an impact mechanism, an impact detector, and a controller.

The impact mechanism includes a hammer, an anvil, and a mounting portion. The hammer rotates by a rotational force of the motor. The anvil rotates by receiving a rotational force of the hammer. The mounting portion is configured to attach a tool bit to the anvil. The impact mechanism is configured such that, in response to application of a torque equal to or greater than a specified value to the anvil, the hammer is detached from the anvil to rotate idle and apply an impact to the anvil in a rotational direction of the hammer.

The impact detector detects the impact applied to the anvil by the hammer. The controller executes drive control of the motor that includes constant duty ratio control and constant rotation speed control. The controller executes the constant duty ratio control from the start of the motor until detection of the impact by the impact detector. Also, the controller executes the constant rotation speed control in response to detection of the impact by the impact detector. The constant duty ratio control is a control method in which a conduction current to the motor is controlled at a constant duty ratio. The constant rotation speed control is a control method in which the conduction current to the motor is controlled so that a measured rotational speed of the motor approaches a constant rotational speed.

That is, in this rotary impact tool, until an impact is detected by the impact detector, the motor is open-loop controlled by a pulse width modulation (PWM) signal having a constant duty ratio. When an impact is detected by the impact detector, the motor is feedback controlled so that the rotational speed approaches a constant target rotational speed.

When the motor is open-loop controlled by the PWM signal having a constant duty ratio, the rotational speed of the motor varies in accordance with a load applied to a rotation shaft of the motor. That is, during no-load or low-load operation of the motor, the motor rotates at high speed. When a load applied to the motor increases such as when an impact is applied to the anvil by the hammer, the rotational speed of the motor decreases.

Therefore, according to this rotary impact tool, from when the motor is started until the load applied to the motor increases, the motor can be rotated at high speed. Thus, the rotational speed after the start of the motor increases, and tightening work of a screw using the rotary impact tool can be efficiently performed.

Also, after the start of the motor, as the load applied to a tool bit attached to the mounting portion of the impact mechanism increases, the rotational speed of the motor decreases. Thus, when an impact by the impact mechanism occurs and the impact is detected by the impact detector, the rotational speed of the motor is sufficiently reduced.

Therefore, according to this rotary impact tool, it is possible to reduce impact failure due to high rotational speed of the motor when an impact is applied, as in the case in which the motor is rotated at high speed in the constant rotation speed control. Also, since impact failure can be reduced in this rotary impact tool, deterioration of each component of the rotary impact tool, including the impact mechanism, due to impact failure can be reduced.

After the start of the constant rotation speed control, the controller may be configured to continue the constant rotation speed control until a driving stop condition of the motor is satisfied. The drive stop condition may be a condition in which the motor should be stopped. Also, the controller may be configured to return the drive control of the motor, in response to no detection of the impact by the impact detector after the start of the constant rotation speed control, from the constant rotation speed control to the constant duty ratio control.

According to the controller configured to return the drive control of the motor from the constant rotation speed control to the constant duty ratio control, for example if a load applied to the tool bit temporarily increases due to a bite of the screw into the workpiece, so that an impact by the impact mechanism occurs, the drive control of the motor can be returned from the constant rotation speed control to the constant duty ratio control.

In this case, until the screw is seated on the workpiece, the motor can be rotated again at high speed. Therefore, work efficiency can be enhanced.

The controller may include a determiner configured to determine whether the rotational speed of the motor can be maintained at the constant rotational speed by the constant rotation speed control during execution of the constant rotation speed control. Also, the controller may be configured to perform notification operation and/or stop operation, in response to determination by the determiner that the rotational speed of the motor cannot be maintained at the constant rotational speed. The controller may be configured to notify a user of the rotary impact tool in the notification operation that the rotational speed of the motor cannot be maintained at the constant rotational speed. The controller may be configured to stop the motor in the stop operation.

In this way, it is possible by the notification operation or the stop operation to notify the user that a tightening torque by the rotary impact tool has decreased, in other words, a power supply voltage for driving the motor has decreased, and to urge the user to replace a power supply portion such as a battery.

Also, the determiner may detect the power supply voltage during driving the motor in determining whether the rotational speed of the motor can be maintained at a constant rotational speed by the constant rotation speed control, to determine whether the power supply voltage is lower than a set voltage.

The controller may be configured to set a variable duty ratio for controlling the conduction current so as to maintain the rotational speed of the motor at the constant rotational speed in the constant rotation speed control.

Further, the determiner may be configured to determine that the rotational speed of the motor cannot be maintained at the constant rotational speed in response to the variable duty ratio equal to or greater than a preset set value being set.

In this determiner, failure of the power supply portion can be determined only by determining the variable duty ratio. Thus, the determiner can be more simply configured as compared to a case of determining failure of the power supply portion by detecting the power supply voltage and the like.

The function of the above-described determiner can be implemented if the controller is configured to control the motor to rotate at a constant rotational speed. Thus, the determiner can be applied also to a device in which, for example, a controller is not configured to execute the constant duty ratio control.

The above-described rotary impact tool may further include a setting portion configured to switchably set a rotation speed mode of the motor to one of rotation speed modes including high speed mode and low speed mode. The controller may be configured to set a constant duty ratio in accordance with the rotation speed mode that is set via the setting portion.

According to the rotary impact tool as above, the user, by setting the rotation speed mode via the setting portion, can optionally switch a maximum rotational speed during no-load or low-load operation, after the start of the motor, to one of stages. This rotary impact tool can be more user-friendly.

In this case, the controller may be configured to execute the constant rotation speed control, without executing the constant duty ratio control, in response to a value of the constant duty ratio equal to or lower than a preset threshold being set.

That is, if the duty ratio set in accordance with the rotation speed mode is low, it takes time to increase a rotation torque of the motor to a torque required for an impact by the impact mechanism. Also, it is possible that the rotation torque of the motor cannot be increased to the torque required.

Thus, when the value of the constant duty ratio is equal to or lower than the threshold, the constant rotation speed control is executed, so as to promptly increase the rotational speed of the motor to a desired rotational speed to thereby enable impact operation by the impact mechanism.

Another aspect of the present disclosure provides a method for controlling a rotary impact tool. The method includes: detecting an impact to an anvil by a hammer, the anvil and the hammer being included in the rotary impact tool; executing constant duty ratio control in which a conduction current to a motor is controlled at a constant duty ratio until detection of the impact, the motor being included in the rotary impact tool, and the motor being configured to rotationally drive the hammer; and executing constant rotation speed control in which the conduction current is controlled so that a rotational speed of the motor approaches a constant rotational speed in response to detection of the impact.

The method as described above can achieve the same effect as in the above-described rotary impact tool.

BRIEF DESCRIPTION OF THE DRAWINGS

An example embodiment of the present disclosure will be described hereinafter with reference to the accompanying drawings, in which.

DETAILED DESCRIPTION OF THE PREFERRED EMBODIMENTS

In the present embodiment, a rechargeable impact driver 1 will be described as an example of a rotary impact tool of the present disclosure. The rechargeable impact driver 1 is used to fix a screw to be tightened, such as a bolt and a nut, to a workpiece.

Figure 1:
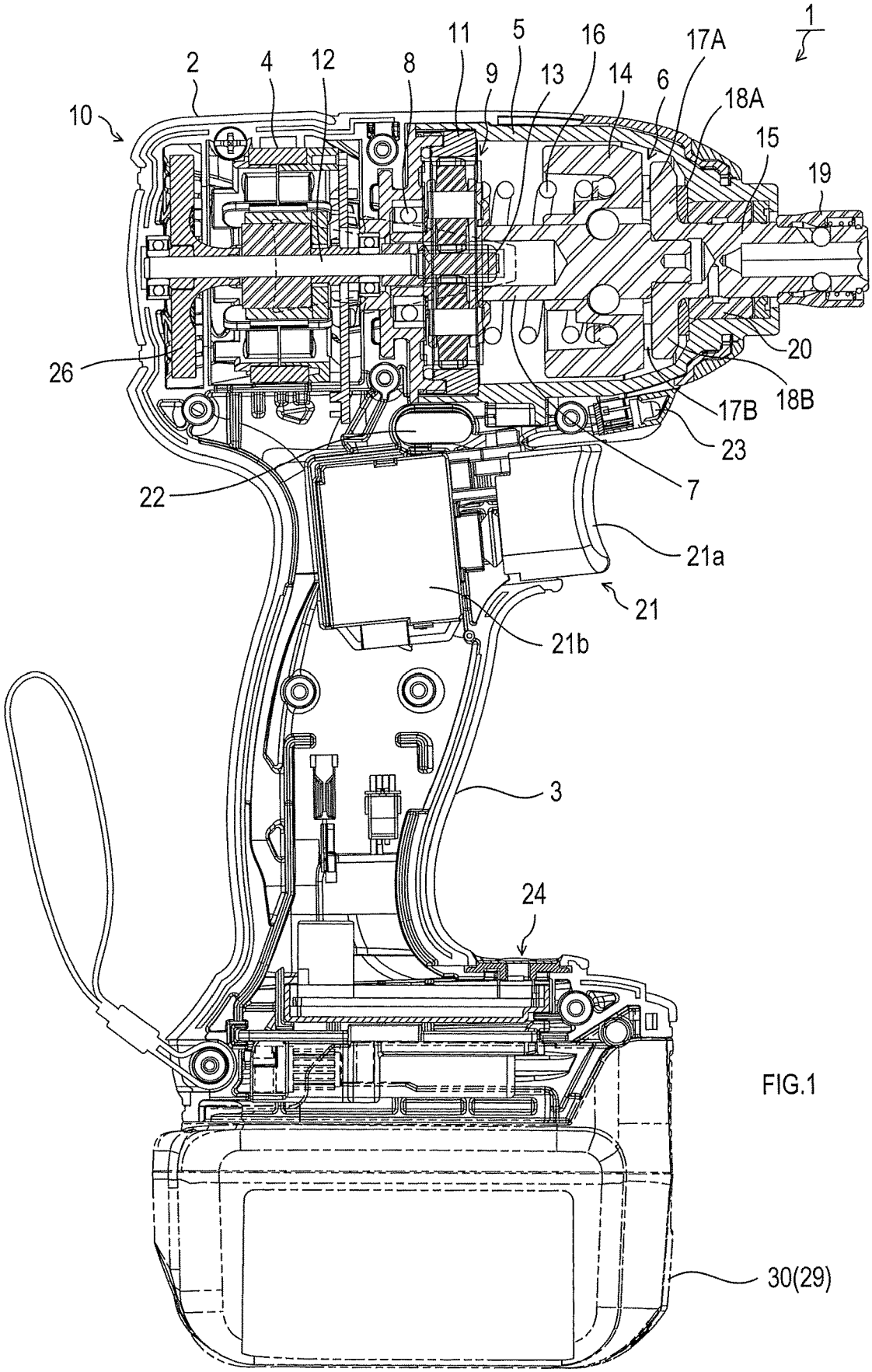
FIG. 1 is a cross sectional view showing an overall configuration of a rotary impact tool according to an embodiment.

As shown in FIG. 1, the rechargeable impact driver 1 of the present embodiment includes a tool body 10, and a battery pack 30 which supplies electric power to the tool body 10. The tool body 10 includes a housing 2 and a grip portion 3. The housing 2 houses a motor 4 and an impact mechanism 6 to be described later, and the like. The grip portion 3 is configured to protrude from a lower part of the housing 2 (the lower side in FIG. 1).

The housing 2 houses the motor 4 at a rear part inside the housing 2 (the left side in FIG. 1). A bell-shaped hammer case 5 is assembled to the front part of the motor 4 (the right side in FIG. 1). The hammer case 5 houses the impact mechanism 6 inside the hammer case 5.

A spindle 7 is housed in and is coaxially with the hammer case 5. A hollow portion is provided at a rear end of the spindle 7. An outer periphery of the rear end of the spindle 7 is pivotally supported by a ball bearing 8 provided at the rear end inside the hammer case 5.

A planetary gear mechanism 9 is provided at a front region of the ball bearing 8. The planetary gear mechanism 9 has two planetary gears rotatably supported in point symmetry with respect to a rotation axis of in the spindle 7. The planetary gear mechanism 9 meshes with an internal gear 11 provided on an inner peripheral surface at the rear end of the hammer case 5.

The planetary gear mechanism 9 meshes with a pinion 13 provided at a leading end portion of an output shaft 12 of the motor 4.

The impact mechanism 6 includes the spindle 7, a hammer 14 externally attached to the spindle 7, an anvil 15 pivotally supported at the front of the hammer 14, and a coil spring 16 configured to bias the hammer 14 forward.

That is, the hammer 14 is coupled to the spindle 7 so as to be rotatable integrally with the spindle 7, and to be movable in an axial direction of the spindle 7. The hammer 14 is biased forward (toward the anvil 15) by the coil spring 16.

A leading end portion of the spindle 7 is rotatably supported by being loosely inserted coaxially to a rear end of the anvil 15.

The anvil 15 rotates about its axis by receiving a rotational force and an impact force of the hammer 14. The anvil 15 is supported to be rotatable about the axis and non-displaceable in an axial direction of the anvil 15 by a bearing 20 provided at a leading end of the housing 2.

In addition, at a leading end portion of the anvil 15, a chuck sleeve 19 for attaching various tool bits (not shown) such as a phillips driver bit or a socket bit is provided as a mounting portion of the tool bit.

The output shaft 12 of the motor 4, the spindle 7, the hammer 14, the anvil 15, and the chuck sleeve 19 are arranged coaxially with each other. On a front end face of the hammer 14, two impact protrusions 17A, 17B (first impact protrusion 17A and second impact protrusion 17B) for applying an impact force to the anvil 15 are provided to protrude at an interval of 180° in a circumferential direction of the hammer 14.

At a rear end of the anvil 15, two impact arms 18A, 18B (first impact arm 18A and second impact arm 18B) are provided at an interval of 180° in the circumferential direction. Each of the impact protrusions 17A, 17B of the hammer 14 are configured to be able to abut on one of the impact arms 18A, 18B (or on 18B and 18A) respectively. In other words, if 17A strikes 18A, then 17B simultaneously strikes 18B. If 17A strikes 18B, then 17B simultaneously strikes 18A. Also, when working properly, 17A will strike 18A, then 18B, then 18A, then 18B, etc.

When the hammer 14 is biased toward and held at a front end of the spindle 7 by a biasing force of the coil spring 16, each of the impact protrusions 17A, 17B of the hammer 14 abuts on one of the impact arms 18A, 18B of the anvil 15.

In this state, when the spindle 7 rotates via the planetary gear mechanism 9 by the rotational force of the motor 4, the hammer 14 rotates together with the spindle 7, and the rotational force of the hammer 14 is transmitted to the anvil 15 via the impact protrusions 17A, 17B and the impact arms 18A, 18B.

As a result, a driver bit or the like attached to the leading end of the anvil 15 rotates, so as to enable screw tightening. When a torque equal to or greater than the specified value is applied to the anvil 15 from outside, due to tightening of a screw to a specified position, the rotational force (torque) of the hammer 14 to the anvil 15 becomes equal to or greater than the specified value.

As a result, the hammer 14 is displaced rearward against the biasing force of the coil spring 16, and each of the impact protrusions 17A, 17B of the hammer 14 jumps over (or slides/slips over) an upper surface of one of the impact arms 18A, 18B of the anvil 15. That is, each of the impact protrusions 17A, 17B of the hammer 14 is temporarily disengaged from one of the impact arms 18A, 18B of the anvil 15 and "rotates idle".

As above, when each of the impact protrusions 17A, 17B of the hammer 14 finishes jumping (or sliding/slipping) over one of the impact arms 18A, 18B of the anvil 15, the hammer 14, while rotating with the spindle 7, is displaced forward again by the biasing force of the coil spring 16, and each of the impact protrusions 17A, 17B of the hammer 14 applies an impact to one of the impact arms 18A, 18B of the anvil 15 in a rotational direction of the hammer 14.

Accordingly, in the rechargeable impact driver 1 of the present disclosure, every time a torque equal to or greater than the specified value is applied to the anvil 15, an impact is soon applied to the anvil 15 by the hammer 14, and this may occur repeatedly. This intermittent application of the impact force of the hammer 14 to the anvil 15 enables screw tightening at intermittent high torque.

In addition, the hammer 14 is slightly displaced rearward against the biasing force of the coil spring 16 after each impact. If this rearward displacement (that is, rebound) increases, impact failure is likely to occur. In impact failure, the hammer 14 jumps over the anvil 15 without applying an impact to the anvil 15 and the number of impact per rotation of the motor decreases, so that torque accuracy deteriorates. Thus, in the present embodiment, in order to avoid rebound of the hammer 14 by an impact, a cooling fan 26 to be attached to a rear end of the output shaft 12 of the motor 4 contains metal having a specific gravity (for example, a metal containing zinc or zinc as a main component) higher than that of synthetic resin.

The fan 26 as such increases inertia of the motor 4 so as to reduce impact failure caused by rebound of the hammer 14.

The grip portion 3 is a part to be gripped by a user of the rechargeable impact driver 1. A trigger switch 21 is provided above the grip portion 3.

The trigger switch 21 includes a trigger 21*a* and a switch body portion 21*b*. The trigger 21*a* is configured to be pulled by the user. The switch body portion 21*b* is turned on by pulling operation of the trigger 21*a*, and is configured to vary a resistance value in accordance with an operation amount (pulling amount) of the trigger 21*a*.

On top of the trigger switch 21 (a lower end of the housing 2), a forward/reverse switch 22 is provided for switching a rotational direction of the motor 4 to one of a forward direction (in the present embodiment, a clockwise direction in a state viewing front from a rear end side of the tool) or a reverse direction (a rotational direction opposite to the forward direction).

A lighting LED 23 is provided at a front lower part of the housing 2. When the trigger 21*a* is pulled, the lighting LED 23 is turned on, and emit lights to the front of the rechargeable impact driver 1.

A display and setting portion 24 is provided at a front lower part of the grip portion 3. The display and setting portion 24 displays remaining energy of a battery 29 inside the battery pack 30 as well as an operation state and the like of the rechargeable impact driver 1, and accepts changes of various set values such as the rotation speed mode of the motor 4.

The rotation speed mode of the motor 4 is set stepwise by an external operation of the user, and is used to set a duty ratio when the motor 4 is PWM controlled at a constant duty ratio. Accordingly, the rotational speed of the motor 4 is set, for example, from among high speed, medium speed, and low speed, in accordance with the set rotation speed mode.

The battery pack 30 which houses the battery 29 is detachably attached to a lower end of the grip portion 3. The battery pack 30 is attached by sliding itself from the front to the rear with respect to the lower end of the grip portion 3.

The battery 29 housed in the battery pack 30 is a rechargeable secondary battery such as a lithium ion secondary battery, in the present embodiment.

Inside the grip portion 3, a controller 40 (see FIG. 2) is provided which controls driving of the motor 4 by receiving power supply from the battery pack 30.

Figure 2:
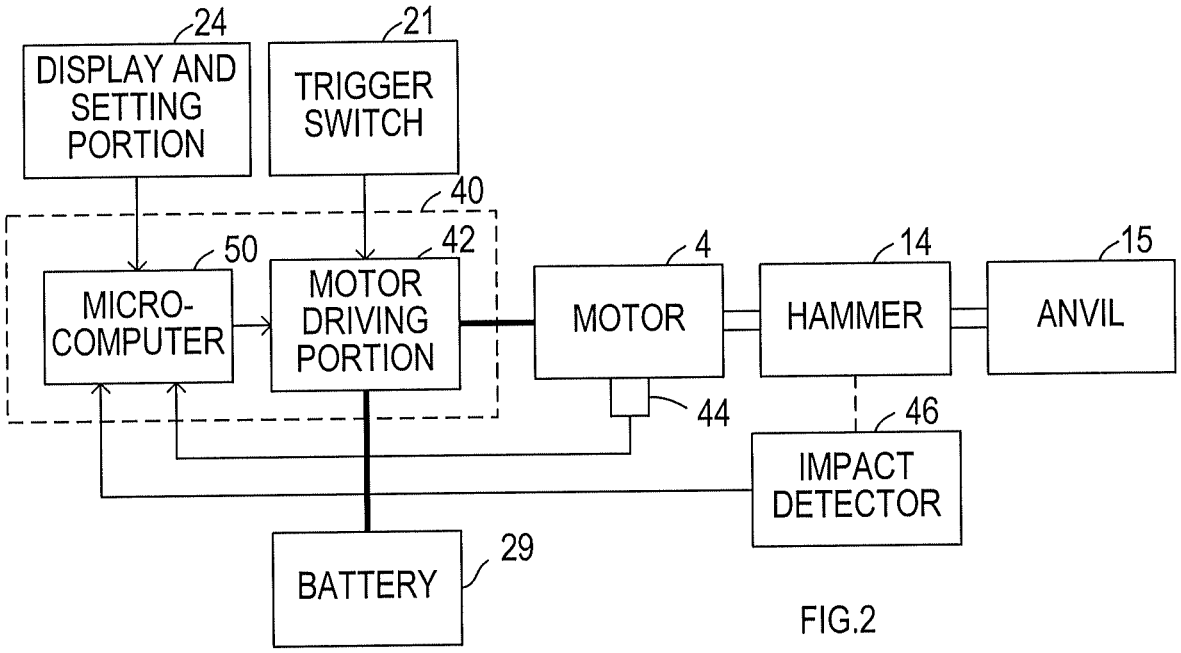
FIG. 2 is a block diagram showing a configuration of a motor drive system of the rotary impact tool.

As shown in FIG. 2, the controller 40 includes a motor driving portion 42 provided in a conduction path from the battery 29 to the motor 4, and a microcomputer 50 that controls a conduction current to the motor 4 via the motor driving portion 42.

In the present embodiment, the motor 4 is preferably a brushless motor. The motor driving portion 42 includes a bridge circuit (not shown). The bridge circuit includes a plurality of switching elements, and is configured to be able to control electric current, and its direction, flowing to the motor 4. The trigger switch 21 is coupled to the motor driving portion 42. The motor driving portion 42, when the trigger switch 21 is operated by the user and is ON, completes the conduction path from the battery 29 to the motor 4.

The microcomputer 50 includes a CPU, a ROM, a RAM, and the like. To the microcomputer 50, the display and setting portion 24, a rotation sensor 44 provided in the motor 4, and an impact detector 46 that detects an impact by the hammer 14 are coupled. Although not shown in FIG. 2, the aforementioned forward/reverse switch 22, lighting LED 23, and trigger switch 21 are also coupled to the microcomputer 50.

The rotation sensor 44 is a known rotation sensor that generates a rotation detection signal at every specified rotation angle of the motor 4. The microcomputer 50, based on the rotation detection signal from the rotation sensor 44, can detect a rotation position and a rotational speed of the motor 4.

The impact detector 46 includes an impact detection element (not shown). The impact detection element detects impact noise or vibration generated by application of an impact to the impact arms 18A, 18B of the anvil 15 by the impact protrusions 17A, 17B of the hammer 14. The impact detector 46 inputs a detection signal from the impact detection element to the microcomputer 50 via a noise removal filter. Thus, the microcomputer 50, based on the detection signal of the impact detector 46, can detect an impact by the hammer 14.

The microcomputer 50, when the trigger switch 21 is ON to drive the motor 4, turns on or off the plurality of switching elements of the motor driving portion 42 by a PWM signal having a specific duty ratio, so as to control the conduction current to the motor 4.

Specifically, the microcomputer 50, at the time of starting the motor 4, sets a specific duty ratio in accordance with the rotation speed mode set by the user via the display and setting portion 24, and outputs a PWM signal of the set constant duty ratio to the motor driving portion 42, so as to PWM control the conduction current to the motor 4.

In this case, the motor 4 is open-loop controlled, and the rotational speed varies in accordance with a load.

Also, in the present embodiment, a cycle of the PWM signal used by the microcomputer 50 to drive motor 4 is set to be shorter than a cycle of an ordinary rotary impact device. That is, a frequency of PWM control is set to be higher (for example 20 kHz) than a general frequency (for example, 8 kHz).

This is to increase effective current flowing to the motor 4 by the PWM control so as to ensure a starting torque of the motor 4, even if a battery voltage decreases. When an impact is detected by the impact detector 46 during driving the motor 4 by the PWM control having the constant duty ratio, control of the motor 4 is changed to constant rotation speed control in which driving of the motor 4 is controlled such that the rotational speed of the motor 4 approaches a target rotational speed set in accordance with the operation amount of the trigger switch 21.

Figure 3:
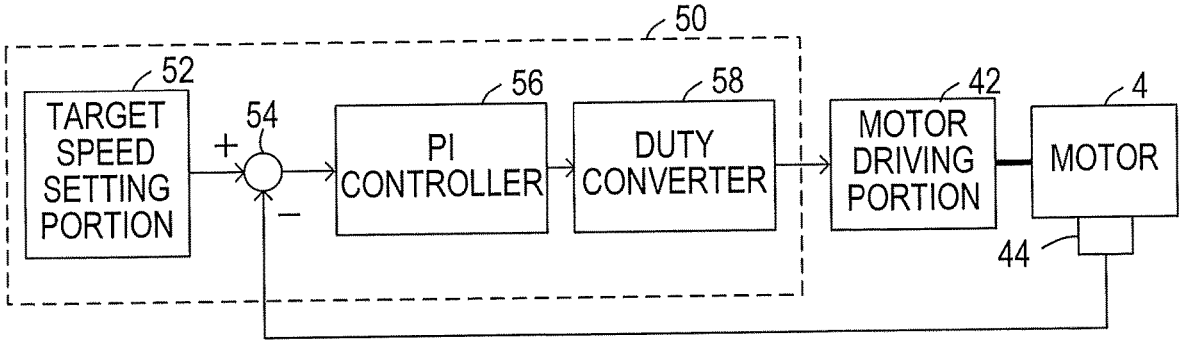
FIG. 3 is a function block diagram showing a configuration of a control system that feedback controls a rotational speed of a motor.

During the constant rotation speed control, the microcomputer 50, as shown in FIG. 3, functions as a target speed setting portion 52, a deviation calculator 54, a PI (proportional integral) controller 56 (or other controller), and a DUTY converter 58, and outputs a PWM signal having a specific duty ratio generated in the DUTY converter 58 to the motor driving portion 42.

That is, the microcomputer 50 sets the target rotational speed of the motor 4 in accordance with the operation amount of the trigger switch 21 in the target speed setting portion 52, calculates a deviation between the target rotational speed and the rotational speed of the motor 4 in the deviation calculator 54, and performs proportional and integral operation on the deviation in the PI controller 56.

The PI controller 56 performs proportional and integral operation on the deviation to calculate a control variable for controlling the rotational speed of the motor 4 to achieve the target rotational speed. The DUTY converter 58 converts the control variable to a duty ratio necessary to PWM control the conduction current to the motor 4. Other potential controllers include, for example, a PID (proportional integral deviation) controller.

As a result, after detection of an impact by the impact detector 46, the motor 4 is feedback controlled so that the rotational speed approaches the target rotational speed. Hereinafter, a drive control process of the motor 4 executed in the microcomputer 50 as such will be described in detail along a flowchart in FIG. 4.

Figure 4:
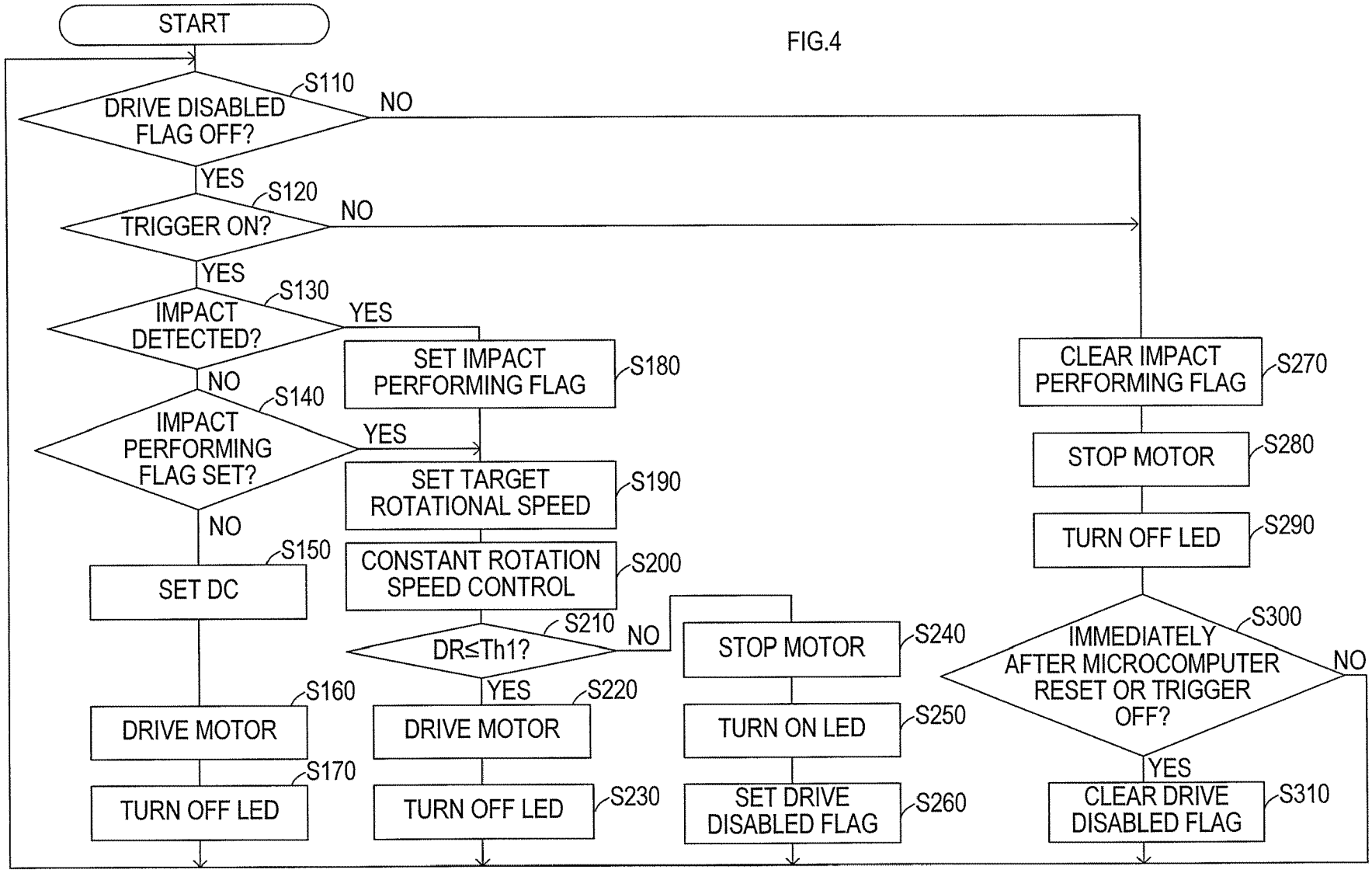
FIG. 4 is a flowchart showing a drive control process of the motor.

As shown in FIG. 4, in the drive control process, it is first determined in S110 (S denotes a step) whether a drive disabled flag that disables driving of the motor 4 is OFF, that is whether driving of the motor 4 is enabled.

When it is determined in S110 that the drive disabled flag is OFF and driving of the motor 4 is enabled, the process moves to S120 to determine whether the trigger switch 21 is ON. If the trigger switch 21 is ON, then the process moves to S130 to determine whether an impact has been detected by the impact detector 46

When it is determined in S130 that no impact has been detected (S130: NO), the process moves to S140 to determine whether a impact performing flag is set. The impact performing flag is a flag which is set in S180, to be described later, when it is determined in S130 that an impact has been detected (S130: YES). When the impact performing flag is not set, the process moves to S150.

In S150, in accordance with the rotation speed mode set by the user, a duty ratio (constant duty ratio DC) upon PWM controlling the motor 4 at a constant duty ratio is set. In subsequent S160, a PWM signal is output to the motor driving portion 42 so that the motor 4 is driven at the set constant duty ratio DC. In subsequent S170, a LED for failure notification provided in the display and setting portion 24 is turned off. Then the process moves to S110.

Figure 5:
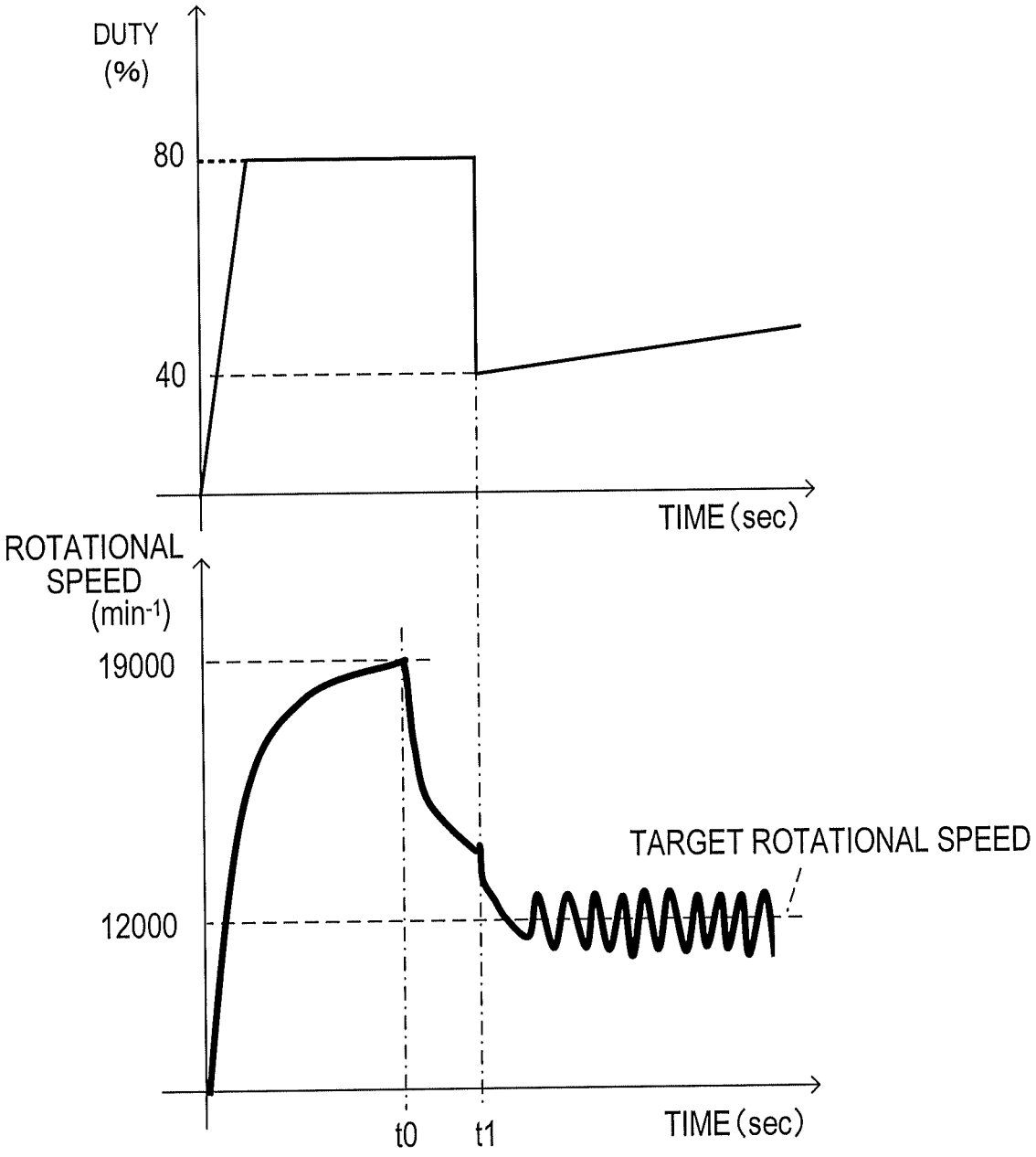
FIG. 5 is a time chart showing changes in a duty ratio and the rotational speed set in the drive control process of the motor.

In S160, the motor 4 is PWM controlled at the constant duty ratio DC. However, immediately after the motor 4 is started, the duty ratio of the PWM signal is gradually increased so that the rotational speed of the motor 4 gradually increases, as shown in FIG. 5. As a result, the motor 4 is gradually accelerated to the rotational speed corresponding to the constant duty ratio DC set in S150, so as to achieve a so-called soft start.

When it is determined in S130 that an impact has been detected (S130: YES), the process moves to S180 to set the impact performing flag, and then moves to S190. Also, when it is determined in S140 that the impact performing flag is set, the process moves to S190.

In S190, in accordance with the operation amount of the trigger switch 21, a target rotational speed (e.g., 12000 rpm for the motor in FIG. 5) to feedback control the motor 4 is set. In subsequent S200, constant rotation speed control is executed. In the constant rotation speed control, the duty ratio of the PWM signal for controlling the conduction current to the motor 4 is controlled so that the rotational speed of the motor 4 approaches the target rotational speed set in S190.

In subsequent S210, it is determined whether the duty ratio DR is equal to or lower than a preset threshold Th1 (for example, 90%). The duty ratio DR indicates the duty ratio of the PWM signal set in the constant rotation speed control of S200. The determination process executed in S210 is a process to implement a function as an example of a determiner of the present disclosure. When it is determined in S210 that the duty ratio DR is equal to or smaller than the threshold Th1 (DR≤Th1), it is determined that the battery 29 is normal and the process moves to S220.

In S220, the PWM signal having the duty ratio DR set in the constant rotation speed control of S200 is output to the motor driving portion 42 so as to drive motor 4. Also, after execution of S220, the LED for failure notification provided in the display and setting portion 24 in S230 is turned off, and the process moves to S110.

Accordingly, as shown in FIG. 5, when an impact is detected by the impact detector 46 at a time t1 while the motor 4, after started, is PWM controlled at the constant duty ratio DC, the control of the motor 4 is changed from open loop control to feedback control.

In the feedback control (that is, in the constant rotation speed control), the duty ratio for controlling the rotational speed of the motor 4 to the target rotational speed is controlled, and the motor 4 is driven by the PWM signal having the controlled duty ratio. As a result, an impact torque of the anvil 15 by the hammer 14 is stabilized, and the screw can be tightened to the workpiece at a desired tightening torque.

In addition, since the motor 4, when started, is PWM controlled by the PWM signal having the constant duty ratio DC, the rotational speed increases to a rotational speed at substantially no load, in low-load state in which the screw is screwed into the workpiece.

Then, at a time t0 shown in FIG. 5, when the screw is seated on the workpiece and the load applied to the motor 4 increases, the rotational speed decreases. Thus, the rotational speed of the motor 4 is sufficiently reduced until the time t1 at which an impact is detected by the impact detector 46.

Therefore, according to the present disclosure, when an impact is detected by the impact detector 46, and the control of the motor 4 is switched to the constant rotation speed control, it is possible to reduce impact failure caused by high rotational speed of the motor 4.

When it is determined in S210 that the duty ratio DR for the constant rotation speed control set in S200 exceeds the threshold Th1 (DR>Th1), it is determined that failure has occurred in the battery 29. The process moves to S240 to stop the motor 4.

In subsequent S250, the LED for failure notification provided in the display and setting portion 24 is turned on. In subsequent S260, the drive disabled flag to disable driving of the motor 4 is set to be ON. Then, the process moves to S110.

Figure 7:
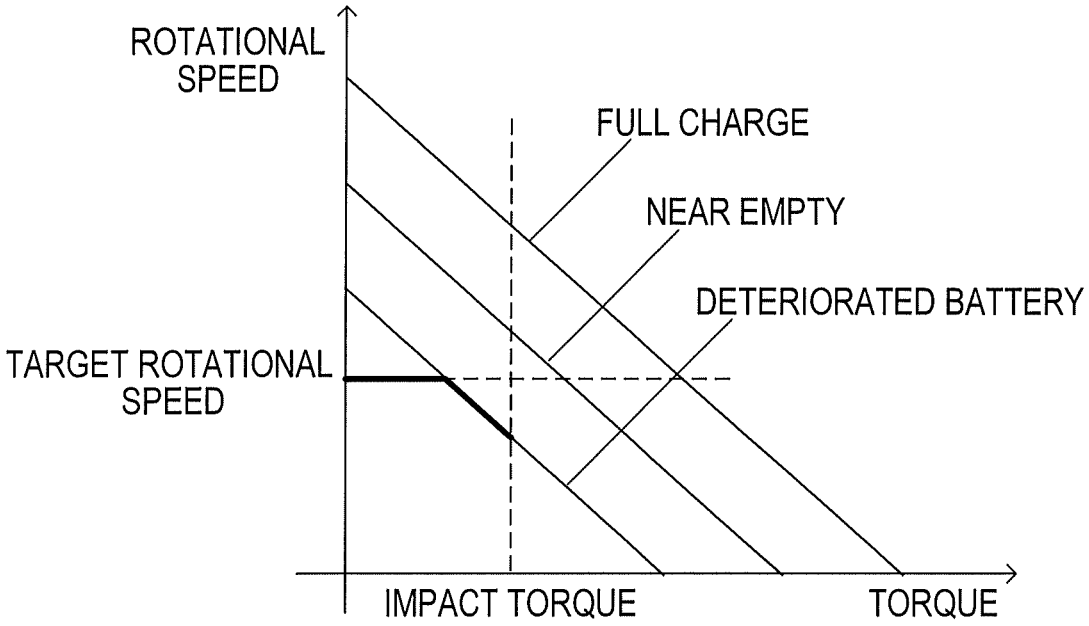
FIG. 7 is an explanatory view showing a relationship between the rotational speed of the motor and a torque.

As above, the reason why it is determined that failure has occurred in the battery 29 when the duty ratio DR exceeds the threshold Th1 is because the impact torque by the hammer 14, as shown in FIG. 7, changes not only by the rotational speed of the motor 4 but also by the state of the battery 29.

That is, a control system of the constant rotation speed control shown in FIG. 3 is designed to control the rotational speed of the motor 4 to the target rotational speed so as to be able to generate a desired impact torque even if remaining energy of the battery 29 is changed from full to near empty due to discharge. The remaining energy indicates an amount of electric power remaining in the battery 29.

However, when the battery 29 is deteriorated and the remaining energy further decreases, the rotational speed of the motor 4 decreases from the target rotational speed before application of an impact. It becomes unable to rotate the motor 4 at the target rotational speed to generate a desired impact torque.

Figure 6:
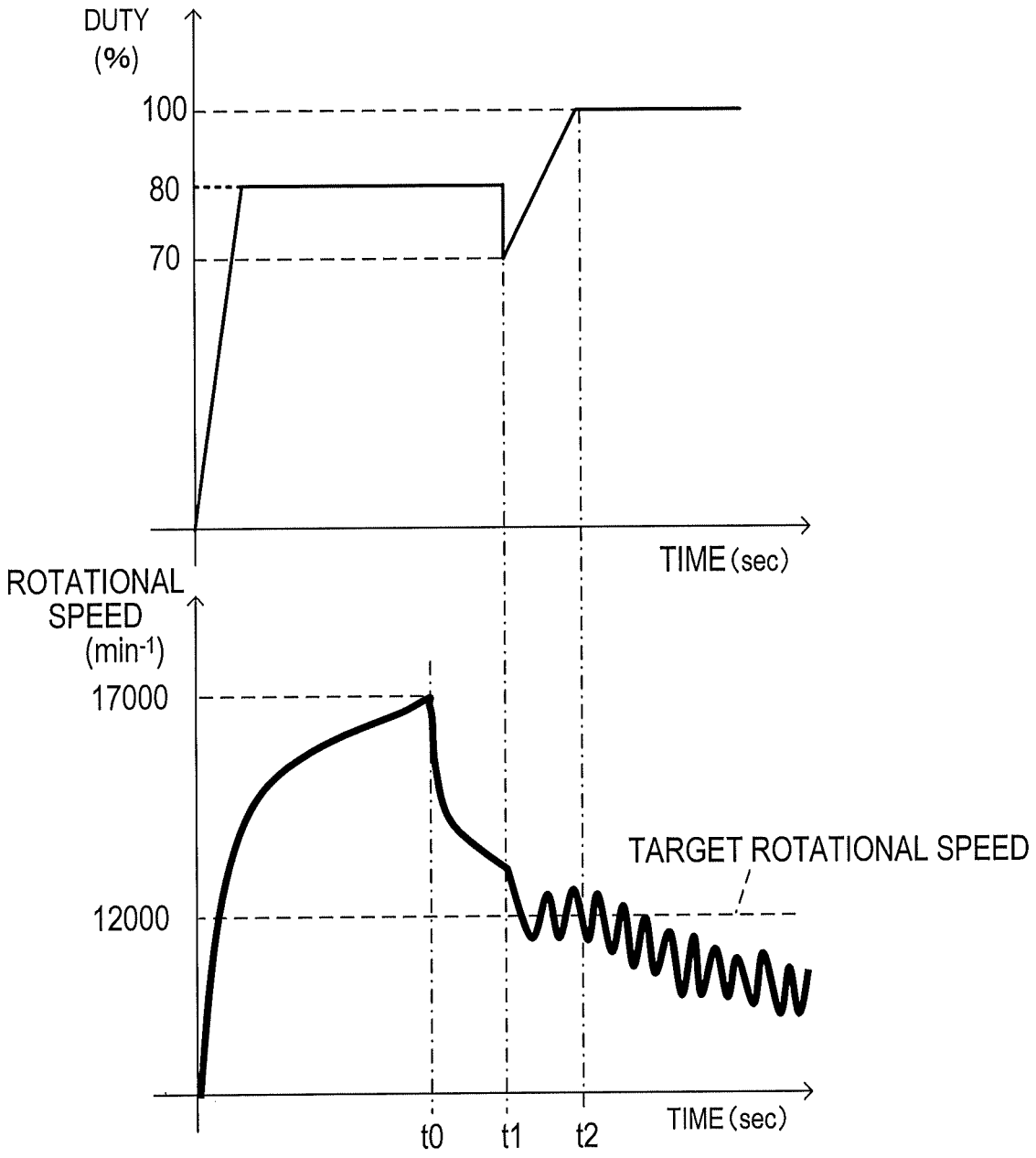
FIG. 6 is a time chart showing changes in the duty ratio and the rotational speed set during low battery voltage.

In this case, as shown in FIG. 6, even if the duty ratio DR increases and reaches 100% at a time t2 while the motor 4 is in the constant rotation speed control, the rotational speed of the motor 4 decreases from the target rotational speed.

Thus, in the present embodiment, one failure state is determined based on the duty ratio DR set in the constant rotation speed control in the process of S210 as the determiner. When failure is determined to have occurred, the motor 4 is stopped and the LED for failure notification is turned on so as to report failure of the battery 29. As a result, it is possible to urge the user to replace the battery pack 30.

In the present embodiment, the threshold Th1 is set to be smaller than 100% so that failure can be determined before the duty ratio DR of the PWM signal in the constant rotation speed control becomes 100%. However, the threshold Th1 may be set to 100%.

Determination of failure in the battery 29 from the duty ratio as such allows determination of failure in the battery 29 without necessity of providing a separate failure detector for determining battery failure from the remaining energy of the battery 29 in the battery pack 30 or in the tool body 10.

When it is determined in S110 that the drive disabled flag is ON or in S120 that the trigger switch 21 is OFF, the impact performing flag is cleared in S270. The process moves to S280 to stop the motor 4.

In subsequent 8290, the LED for failure notification provided in the display and setting portion 24 is turned off. In S300, it is determined whether it is immediately after the microcomputer 50 is reset, or the trigger switch 21 is OFF.

When it is determined in S300 that the microcomputer 50 is immediately after reset, or the trigger switch 21 is OFF, the process moves to S310 to clear the drive disabled flag, and the moves to S110. Also, if it is determined in S300 that the microcomputer 50 is not immediately after reset and the trigger switch 21 is not OFF, the process directly moves to S110.

Accordingly, when the drive disabled flag is once reset in S260, the drive disabled flag is left to be ON until the trigger switch 21 is turned off or the microcomputer 50 is reset thereafter, and driving of the motor 4 is disabled.

In S300, the determination on whether the trigger switch 21 is OFF may not be performed and the determination on only whether the microcomputer 50 is reset may be performed. In this way, once the drive disabled flag is set in S260, the drive disabled flag is left to be ON so as to disable driving of the motor 4, until the battery pack 30 is replaced and the microcomputer 50 is reset thereafter.

Accordingly, in this case, when the duty ratio DR of the constant rotation speed control repeatedly exceeds the threshold Th1 in combination of the rechargeable impact driver 1 and the battery pack 30, continued use of the (discharged) battery pack 30 can be avoided.

That is, when the remaining energy of the battery pack 30 decreases and/or internal resistance of the battery pack 30 increases, it is highly probable that the duty ratio DR of the constant rotation speed control exceeds the threshold Th1 (at S210) and the drive disabled flag is set (at S260).

First, if the drive disabled flag is cleared merely because the trigger switch 21 is OFF (not shown, and contrary to FIG. 4), then the battery pack 30 is used each time the trigger switch 21 is operated, and this makes it easier for the battery pack 30 to deteriorate (due to continued operation in a discharged state). Also, in this case, there is a possibility that a proper torque cannot be output.

If the clearing conditions of the drive disabled flag further requires that the microcomputer 50 is recently reset (in addition to the trigger being off, as shown in S300 in FIG. 4), then driving of the motor 4 is disabled until the battery pack 30 is replaced (which resets the microcomputer 50), so that deterioration of the battery pack 30 can be reduced and tightening of the screw at an improper torque can be avoided.

As described in the above, in the rechargeable impact driver 1 of the present disclosure, when the trigger switch 21 is operated to start the motor 4, the motor 4 is driven by the PWM signal having the constant duty ratio DC set in accordance with the rotation speed mode (high speed mode or low speed mode, previously set) in S150, in the context of an optional soft start.

When an impact of the anvil 15 by the hammer 14 is detected by the impact detector 46 after the motor 4 is started, the motor 4 is placed in a constant rotation speed mode in S200, so that the rotational speed of the motor 4 approaches the target rotational speed set in accordance with the operation amount of the trigger switch 21.

Thus, after the motor 4 is started, until the load applied to the motor 4 increases and an impact is applied, it is possible to increase the rotational speed of the motor 4 and make the screw promptly seated on the workpiece (for example, by soft starting to 80% duty, then maintaining 80% duty). Also, until the screw is seated on the workpiece and an impact is detected by the impact detector 46, the load applied to the motor 4 may increase. Therefore, the rotational speed of the motor 4 may decrease as the load increases, until an impact is detected at S130.

As a result, according to the rechargeable impact driver 1 of the present disclosure, time required for the screw to be screwed into the workpiece can be reduced, thereby increasing work efficiency. Moreover, impact failure due to high rotational speed of the motor 4 upon application of an impact can be reduced.

When the constant rotation speed control is executed so that the rotational speed of the motor 4 is controlled to approach the target rotational speed, failure (deterioration) of the battery 29 is determined from the duty ratio DR of the PWM signal set for the constant rotation speed control (when DR exceeds Th1).

When failure is determined to have occurred, the motor 4 is stopped and the LED for failure notification is turned on. Therefore, the user can be notified of the failure in the battery 29, and urged to replace the battery pack 30.

The embodiment of the present disclosure has been described in the above. However, the present disclosure is not limited to the above-described embodiment, and can take various modes within the scope not departing from the gist of the present disclosure.

[Variation 1]

As discussed above in the base embodiment of FIG. 4, after the motor 4 is started, when an impact is detected by the impact detector 46 (S130), detection of impact is stored by setting the impact performing flag (S180), and thereafter continues the constant rotation speed control (S200) of the motor 4 until the motor 4 is stopped.

Figure 8:
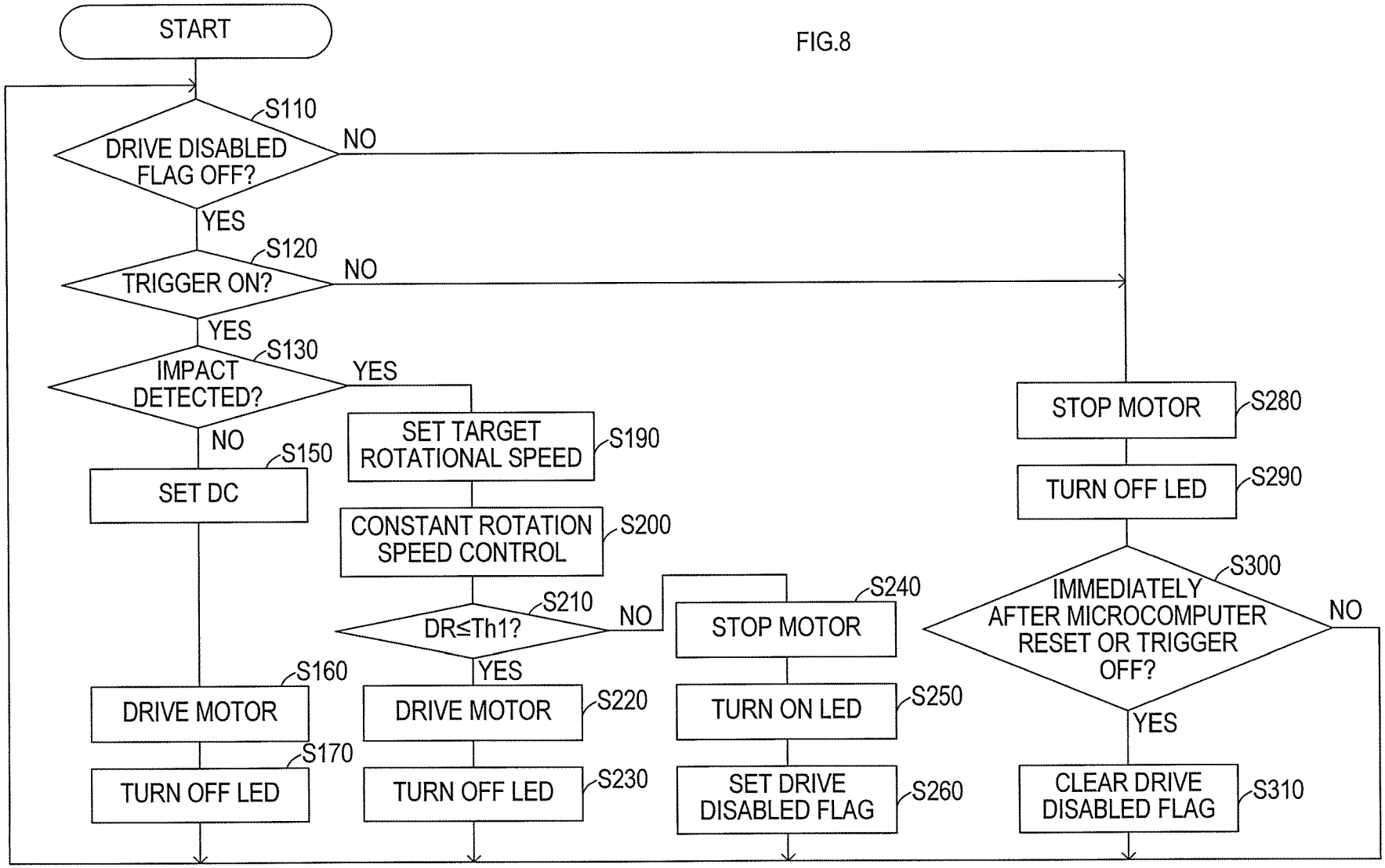
FIG. 8 is a flowchart showing a first variation of the drive control process of the motor.

In contrast, in Variation 1 as shown in FIG. 8, the processes of S140, S180, and S270 shown in FIG. 4 in drive control process may be removed, so that the constant rotation speed control may be executed while an impact is detected by the impact detector 46.

That is, even if it is determined in S130 that an impact has been detected and the constant rotation speed control of the motor 4 is started (S130 and then S190 on a first pass through the logic of FIG. 8), if it is later determined (after looping back up and passing through S130 a second time) in S130 that an impact has not been detected thereafter, the control of the motor 4 is returned to the PWM control having the constant duty ratio DC (in S150).

In this way, for example, after the motor 4 is started, if the screw bites into the workpiece and a load applied to the chuck sleeve 19 from various tool bits temporarily increases so that an impact sporadically occurs, the control of the motor 4 can be returned from the constant rotation speed control to the PWM control having the constant duty ratio DC.

Accordingly, in this case, since the motor 4 can be rotated at high speed once again, work efficiency can be increased. Similarly, constant rotation speed control may be maintained for a predetermined number of impacts (such as 10 impacts, using an impact counter), and then control may be returned to the constant duty ratio.

[Variation 2]

In the base embodiment of FIG. 4, the duty ratio (the constant duty ratio DC) controlling the motor by the PWM signal may be set in accordance with the rotation speed mode (high speed mode or low speed mode) set via the display and setting portion 24.

In the case of the base embodiment, for example, if the rotation speed mode is low speed mode and the duty ratio is low, it is unable to generate a sufficient starting torque at the time of starting the motor 4. It sometimes takes time to increase the torque to a torque required to apply an impact. Also, the required torque may not be able to be reached.

Figure 9:
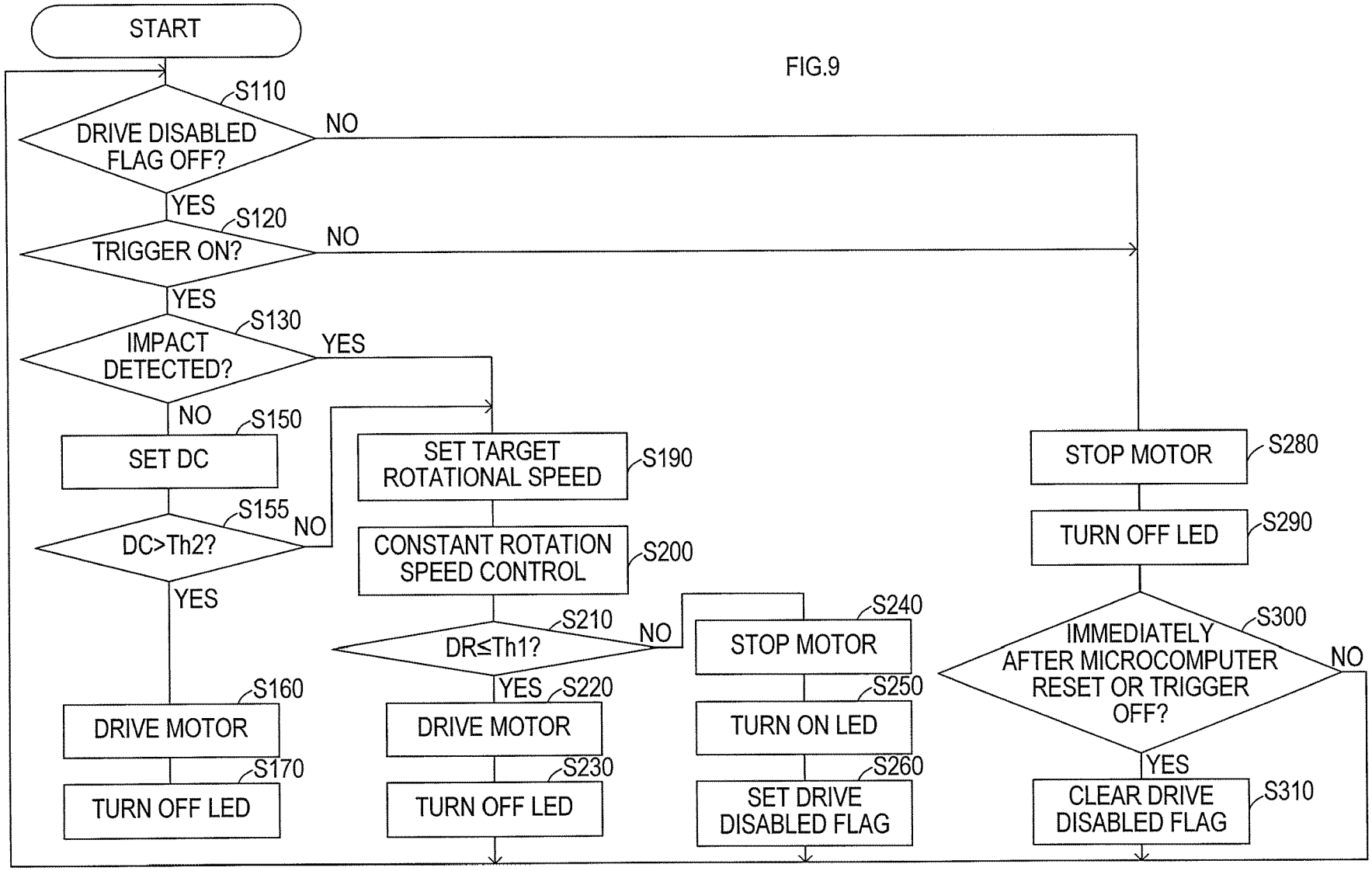
FIG. 9 is a flowchart showing a second variation of the drive control process of the motor.

Thus, as shown in FIG. 9, in the drive control process, if the constant duty ratio DC is set in accordance with the rotation speed mode in S150, it may be determined in subsequent S155 whether the set constant duty ratio DC is greater than a preset threshold Th2.

In this case, if it is determined in S155 that the constant duty ratio DC is greater than the threshold Th2 (DC>Th2), the process proceeds to S160 to execute the PWM control of the motor 4 at the constant duty ratio DC. When it is determined in S155 that the constant duty ratio DC is equal to or smaller than the threshold Th2 (DC≤Th2), the process proceeds to S190.

In this way, when the constant duty ratio DC set in accordance with the rotation speed mode is equal to or smaller than the threshold Th2 and the motor 4 cannot be driven at a desired starting torque, the constant rotation speed control can be executed. In the constant rotation speed control, since the rotational speed of the motor can be increased to the target rotational speed, impact operation by the hammer 14 can be reliably performed.

[Other Variations]

In Variation 2 of FIG. 9, the rotational speed during no load when the motor 4 is driven by the PWM signal having the constant duty ratio DC set in S150 (low speed mode or high speed mode) may be calculated in S155, and it may be determined whether the rotational speed is equal to or smaller than a preset threshold.

In this way, if a maximum rotational speed when the motor 4 is driven by the PWM signal having the constant duty ratio is equal to or smaller than the threshold, and a desired torque cannot be generated, the constant rotation speed control can be executed. The same effect as above can be achieved.

In the base embodiment of FIG. 4, the impact detector 46 detects impact noise or vibration generated upon application of an impact, thereby detecting an impact. The impact detector 46 may be configured to detect an impact from rotational fluctuation of the motor 4 generated upon application of an impact, or current fluctuations generated upon application of an impact, or other methods. A method on how to detect an impact from rotational fluctuation from a motor is disclosed in, for example, the publication of Japanese Patent No. 5784473, and thus a detailed description thereof is not given.

Also, a plurality of functions of a single component in the above embodiments may be achieved by a plurality of components, or a single function of a single component may be achieved by a plurality of components. Further, a plurality of functions of a plurality of components may be achieved by a single component, or a single function of a plurality of components may be achieved by a single component. It is also possible to omit a part of the configuration of the above-described embodiments. Further, at least part of the configuration of any of the above-described embodiments the component of any of the above embodiments ay be added or substituted to the other of the embodiments. Any aspects included in the technical idea specified from language as set forth in the appended claims are embodiments of the present disclosure.

What is claimed is:

1. A rotary impact tool comprising:

a motor;

an impact mechanism including:

a hammer configured to rotate by a rotational force of the motor;

an anvil configured to rotate by receiving a rotational force of the hammer; and a mounting portion configured to attach a tool bit to the anvil, the impact mechanism being configured such that, in response to application of a torque equal to or greater than a specified value to the anvil, the hammer is detached from the anvil to rotate idle and to then apply an impact to the anvil in a rotational direction of the hammer;

an impact detector configured to detect the impact applied to the anvil by the hammer;

a controller including a constant duty ratio control circuit and a constant rotational speed control circuit, the constant duty ratio control circuit being configured to open-loop control the motor by a pulse width modulation signal having a constant duty ratio in response to start of the motor, and the constant rotational speed control circuit being configured to control the motor so that a rotational speed of the motor approaches a constant rotational speed in response to detection of the impact by the impact detector; and a setting portion configured to switchably set a rotational speed mode of the motor to one of rotational speed modes including high speed mode and low speed mode, wherein the constant duty ratio control circuit is configured to set the constant duty ratio in accordance with the rotational speed mode that is set via the setting portion, and wherein the constant rotational speed control circuit is configured to control the motor, alternatively to the constant duty ratio control circuit, in response to a value of the constant duty ratio being set equal to or lower than a preset threshold.

2. A rotary impact tool comprising:

a motor;

an impact mechanism including:

a hammer configured to rotate by a rotational force of the motor;

an anvil configured to rotate by receiving a rotational force of the hammer; and a mounting portion configured to attach a tool bit to the anvil, the impact mechanism being configured such that, in response to application of a torque equal to or greater than a specified value to the anvil, the hammer is detached from the anvil to rotate idle and to then apply an impact to the anvil in a rotational direction of the hammer;

an impact detector configured to detect the impact applied to the anvil by the hammer; and a controller programmed to perform:

a first function that open-loop controls a conduction current to the motor by a pulse width modulation signal having a fixed duty ratio in response to start of the motor;

a second function that controls the conduction current so that a rotational speed of the motor approaches a constant rotational speed in response to detection of the impact by the impact detector;

a fourth function that determines whether the rotational speed of the motor can be maintained at the constant rotational speed; and a fifth function that performs notification operation and/or stop operation, in response to determination that the rotational speed of the motor cannot be maintained at the constant rotational speed, the fifth function notifies a user of the rotary impact tool in the notification operation that the rotational speed of the motor cannot be maintained at the constant rotational speed, and the fifth function stops the motor in the stop operation.

3. The rotary impact tool according to claim 2, wherein the second function sets a variable duty ratio for controlling the conduction current so as to maintain the rotational speed of the motor at the constant rotational speed.

4. The rotary impact tool according to claim 3, wherein the controller is further programmed to perform a sixth function that determines that the rotational speed of the motor cannot be maintained at the constant rotational speed in response to the variable duty ratio being set equal to or greater than a preset set value.

5. A rotary impact tool comprising:

a motor;

an impact mechanism including:

a hammer configured to rotate by a rotational force of the motor;

an anvil configured to rotate by receiving a rotational force of the hammer; and a mounting portion configured to attach a tool bit to the anvil, the impact mechanism being configured such that, in response to application of a torque equal to or greater than a specified value to the anvil, the hammer is detached from the anvil to rotate idle and to then apply an impact to the anvil in a rotational direction of the hammer;

an impact detector configured to detect the impact applied to the anvil by the hammer;

a setting portion configured to switchably set a rotational speed mode of the motor to one of rotational speed modes including high speed mode and low speed mode; and a controller programmed to perform:

a first function that open-loop controls a conduction current to the motor by a pulse width modulation signal having a fixed duty ratio in response to start of the motor; and a second function that controls the conduction current so that a rotational speed of the motor approaches a constant rotational speed in response to detection of the impact by the impact detector, wherein the first function sets the fixed duty ratio in accordance with the rotational speed mode that is set via the setting portion, and the second function controls the conduction current alternatively to the first function in response to the fixed duty ratio being set equal to or lower than a preset threshold.

* * * * *